US010398004B1

(12) United States Patent
Cheng

(10) Patent No.: US 10,398,004 B1
(45) Date of Patent: Aug. 27, 2019

(54) LED FLUORESCENT LAMP EMULATOR CIRCUITRY

(71) Applicant: ELB Electronics, Inc., Arcadia, CA (US)

(72) Inventor: Xiaoxiang Cheng, Shanghai (CN)

(73) Assignee: ELB ELECTRONICS, INC., Arcadia, CA (US)

( * ) Notice: Subject to any disclaimer, the term of this patent is extended or adjusted under 35 U.S.C. 154(b) by 0 days.

(21) Appl. No.: 16/029,522

(22) Filed: Jul. 6, 2018

(51) Int. Cl.
*H05B 33/08* (2006.01)

(52) U.S. Cl.
CPC ..... *H05B 33/089* (2013.01)

(58) Field of Classification Search
None
See application file for complete search history.

(56) References Cited

U.S. PATENT DOCUMENTS 3,921,035 A * 11/1975 Holmes ..... H02M 3/1563 315/205
4,507,698 A * 3/1985 Nilssen ..... H02H 3/33 315/DIG. 7
7,804,256 B2 * 9/2010 Melanson ..... H05B 33/0815 315/224
7,862,195 B2 * 1/2011 Stack ..... A47F 3/001 362/125
8,502,454 B2 * 8/2013 Sadwick ..... H05B 33/0809 315/291
8,963,535 B1 * 2/2015 Melanson ..... G01R 33/07 307/116
9,301,365 B2 * 3/2016 Reed ..... H05B 33/0815
9,338,853 B2 * 5/2016 Guang ..... H05B 33/0803
9,644,800 B2 * 5/2017 Purdy ..... F21K 9/60
9,651,225 B2 * 5/2017 Purdy ..... F21V 17/16
9,713,236 B1 * 7/2017 Purdy ..... H05B 37/0281
9,839,077 B2 * 12/2017 Choi ..... H05B 33/0809
10,024,502 B1 * 7/2018 Purdy ..... F21K 9/272
2009/0243558 A1 * 10/2009 Henze ..... H05B 41/2853 320/166
2010/0225239 A1 * 9/2010 King ..... H05B 41/2827 315/224
2012/0249014 A1 * 10/2012 Mei ..... H05B 33/0884 315/307
2014/0252970 A1 * 9/2014 Lopez ..... H05B 37/02 315/200 R
2014/0300274 A1 * 10/2014 Acatrinei ..... H05B 33/0815 315/85
2015/0260384 A1 * 9/2015 Purdy ..... H05B 33/0845 362/221
2015/0345712 A1 * 12/2015 Purdy ..... F21K 9/60 362/223
2015/0345755 A1 * 12/2015 Purdy ..... F21V 17/16 362/219

(Continued)

*Primary Examiner* — Dion Ferguson
*Assistant Examiner* — Srinivas Sathiraju
(74) *Attorney, Agent, or Firm* — Karish & Bjorgum, PC

(57) ABSTRACT

Circuitry 31 for a solid-state lighting arrangement 20 designed for as a replacement for a gas discharge lamp used in a lighting fixture having a ballast. The circuitry 31 unsafe flow of current through the solid-state lighting arrangement 20, under non-operational conditions and during installation of the lighting arrangement, so as to provide compatibility with safety standards for use with discharge lamps.

3 Claims, 6 Drawing Sheets

(56) References Cited

U.S. PATENT DOCUMENTS

| | | | | |
|---|---|---|---|---|
| 2016/0047535 | A1* | 2/2016 | Purdy | F21K 9/23 362/220 |
| 2017/0105265 | A1* | 4/2017 | Sadwick | A61N 5/0618 |
| 2018/0279429 | A1* | 9/2018 | Sadwick | H05B 37/0245 |

* cited by examiner

LED FLUORESCENT LAMP EMULATOR CIRCUITRY

FIELD OF INVENTION

The present invention relates to lighting in commercial and residential environments, and more particularly to a solid-state lighting arrangement that is a drop-in replacement for conventional ballasted gas discharge lamps. This invention more particularly relates to a solid-state lighting arrangement that includes a circuitry to allow for safe operation and compliance with existing safety standards originally drafted for conventional ballasted gas discharge lamps, e.g. fluorescent lamps.

BACKGROUND OF THE INVENTION

Due to advances in semiconductors and related technologies, light-emitting diodes (LEDs) have become so cost-effective as to make them feasible for lighting systems that previously relied upon incandescent or discharge lamps. Consequently, a substantial variety of LED-based replacement solutions have become available.

In the realm of household lighting, replacement of incandescent bulbs with bulbs that utilize LEDs has become commonplace. LED-based bulbs are still more costly than standard incandescent bulbs, but offer certain advantages, such as improved energy efficiency and much greater operating life.

In the realm of industrial lighting (e.g., factories and warehouses) and area lighting (e.g., office spaces and large residential spaces), the transition from conventional light sources to LED-based light sources has likewise proceeded at a fast pace. One of the major challenges has been the fact that many of those environments include large numbers of lighting fixtures which already include ballasts (magnetic and/or electronic) that are specifically designed for powering discharge lamps.

In recent years, many efforts have been directed to the challenge of providing LED-based light sources that are so-called "drop in" replacements for existing discharge lamps. These "drop-in" replacement LED-based light sources are commonly housed within a package resembling that of a conventional discharge lamp tube, which is typically a linear tube with mercury or gas inside. The solid-state replacement typically includes a number of LEDs (arranged in various series, or series-parallel, combinations), along with associated circuitry, to functionally take the place of the discharge lamp(s) that they replace. Description of such "drop-in" replacements may be found in U.S. Pat. No. 9,713,236 and U.S. patent application Ser. No. 14/644,111 (published as 2015/0260384, which have the same assignee as the present application.

In the conventional discharge lamp tube each end has two pins are connected to a filament between them. The result is a pair of pins and filament at each end of the lamp. Typical lamp lengths are 2-foot, 3-foot, 4-foot and 8-foot lengths although other sizes are available for special applications. The lamps with two pins at each end are known as bipin lamps.

Ballast are traditionally needed to drive these conventional lamps. The ballast can be low frequency magnetic that operate at 60 Hz or a high frequency ballast that converts the main voltage, 120 Vac at 60 Hz, to a high frequency AC sinusoidal waveforms at the proper voltage to drive the lamps. Typically, high frequency is 20 Khz to 65 Khz.

The conventional, discharge lamps operate by containing a gas within the tube, which ionizes when sufficient voltage is provided across the pins at the ends. The excitation of the gas results in the release of energy that causes the phosphor coating on the interior of the tube to glow, thus providing light. As described above, LED replacement lamps typically use a string of light emitting diodes to functionally replace the gas filled tube.

A traditional fluorescent lamp for example is non-conductive until the voltage between the two filaments is great enough to ionize the gas in the lamp and cause it's impedance to drop and conduct current. This current causes light in the lamp. The ionization voltage varies with the heating of the two filaments at each end of the lamp. By applying a small AC voltage across each filament, current flow heats the filaments and lowers the ionization voltage.

Both magnetic and high-frequency ballasts are designed to keep the voltage across the lamp or lamps less than ionization level until the filaments are heated. The voltage required to ionize the lamp reduces as the filaments are sufficiently heated.

High frequency ballasts are isolated from the main voltage and ground by an isolation transformer as part of the high-frequency inverter. Magnetic ballasts, however, are simple non-isolated autotransformers that have voltage potential relative to safety ground. When replacing lamp with the ballast energized there is a potential shock hazard between the bipins of the lamp and the safety grounded fixture. This can happen when only one end of the lamp is inserted in to the lamp holder.

Safety standards have been developed fluorescent lamp ballasts, including standard UL935. UL935 specifically includes a standard test for current shock and has a test for lamps when one end is inserted into an energized ballast. UL limits are 5 millamps rms or 7.07 millamps peak, when voltage applied to the inputs is 170 Vac rms, or less. Recently, UL modified the standard to include LED replacement lamps that are being used with existing conventional ballasts intended for use with fluorescent lamps. The voltage at which current may flow in some LED replacement lamps may be much lower than that for a fluorescent lamp, e.g. 70 V to 90 V for a 4 foot lamp.

When LED lamps are used on high frequency electronics, the UL935 test is readily met. However, magnetic ballast output leads are not DC isolated from the mains voltage and safety ground. Any resulting voltage which may exist in a magnetic ballast is insufficient to ionize the gas and cause conduction above the test limits for a conventional discharge lamp. However, LED lamps have much lower conduction voltage than a traditional fluorescent lamp and conduction can occur, and the UL935 test failed, for voltages exceeding the conduction voltage of the LED lamp. The need exists, therefore, for the design of circuitry which may be included in an LED drop-in replacement lamp which more closely emulates the behavior of a traditional fluorescent lamp and satisfies the safety requirements of UL935.

SUMMARY OF THE INVENTION

A fluorescent lamp has high impedance before it ionizes. Only glow current less than 1 ma flows thru the lamp when the ballast starts and the open circuit voltage is less than the ionization voltage. Filament voltage lowers the ionization voltage across the lamp. The purpose of this invention is to emulate operation of a fluorescent lamp with LED replacement lamp that will operate normally on both magnetic and electronic ballast and prevent failure of the UL935 thru lamp leakage test.

One method of accomplishing the emulation is to place an AC switch in series with the AC current path of the lamp at each filament end of the ballast. The AC switches can be designed to turn on only when a specific set of conditions occur as would in a fluorescent lamp. Both switches at each filament end must turn on for current to flow thru the LED lamps. The switches can AC switch elements mechanically or electronically, e.g., using a relay or a triac (aka bilateral triode thyristor). The switches can be latching, or responsive and on only when switching conditions exist.

Although other options and embodiments exist, one approach is to maintain an AC switch in the open state until filament voltage is present either instantaneously or after a delay in time to emulate heating of the filament.

BRIEF DESCRIPTION OF THE DRAWINGS

The features, aspects and advantages of the present invention will become better understood with regard to the following description, appended claims and accompanying figures wherein:

DETAILED DESCRIPTION

In the following description of the preferred embodiments, reference is made to the accompanying drawings which show by way of illustration specific embodiments in which the invention may be practiced. Wherever possible, the same reference numbers will be used throughout the drawings to refer to the same or like parts. It is to be understood that other embodiments may be utilized and structural and functional changes may be made without departing from the scope of the present invention.

Figure 1:
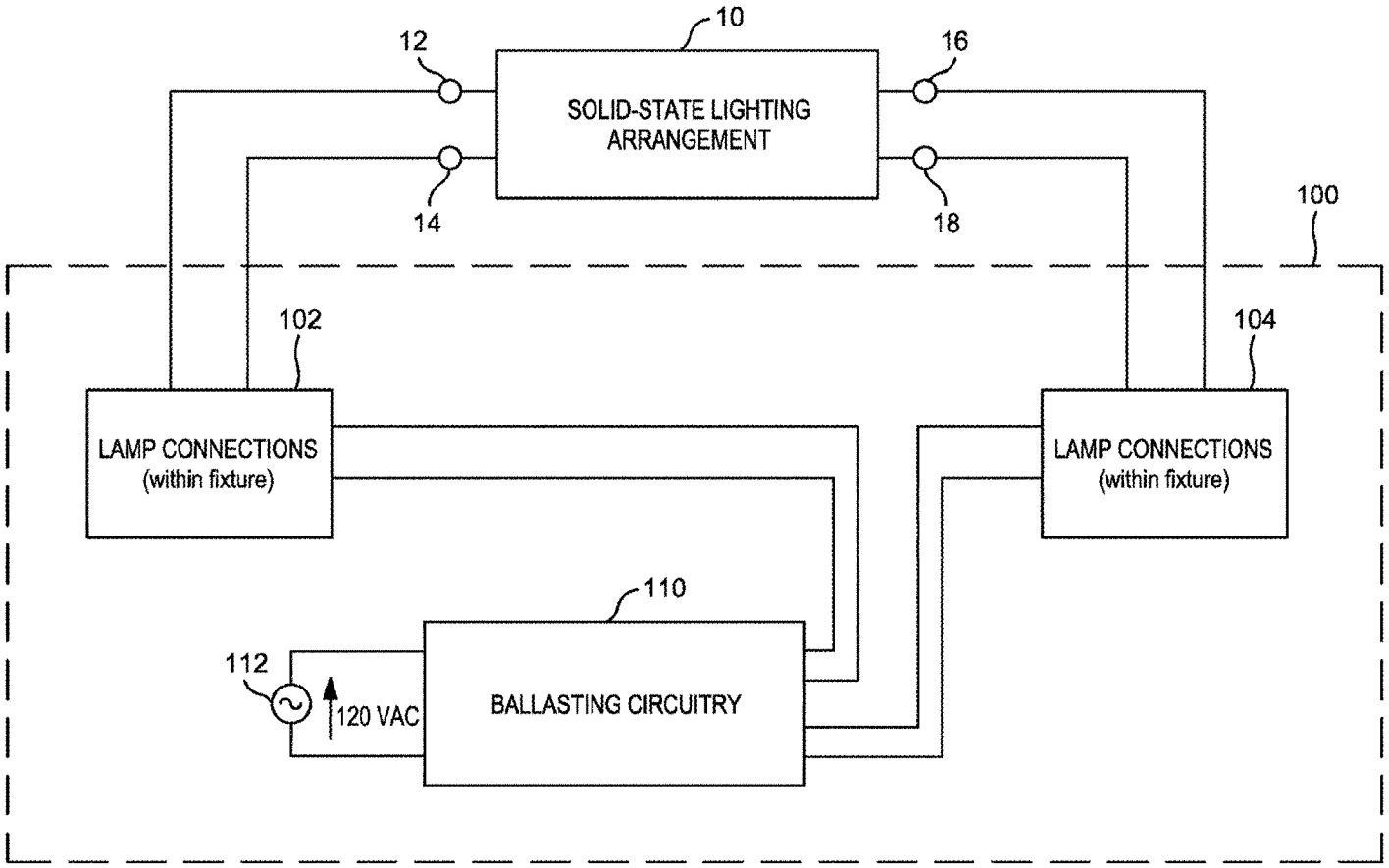
FIG. 1 is a block-diagram illustrating a solid-state lighting arrangement and a lighting fixture that includes a ballast.

FIG. 1 depicts a solid-state lighting arrangement 10 that is intended as a drop-in discharge lamp replacement for use within an existing lighting fixture 100.

As described in FIG. 1, lighting fixture 100 includes lamp connections 102, 104 (between which one or more lamps are usually connected) and ballasting circuitry 110 (which typically receives a conventional source 112 of AC power, such as 120 volts rms at 60 hertz).

During operation, ballasting circuitry 110 provides a suitable source of electrical power between lamp connections 102, 104 for igniting and powering one or more discharge lamps.

Referring again to FIG. 1, solid-state lighting arrangement 10 has inputs 12,14,16,18 which are suitable for connection to lamp connections 102,104 within lighting fixture 100.

Figure 2:
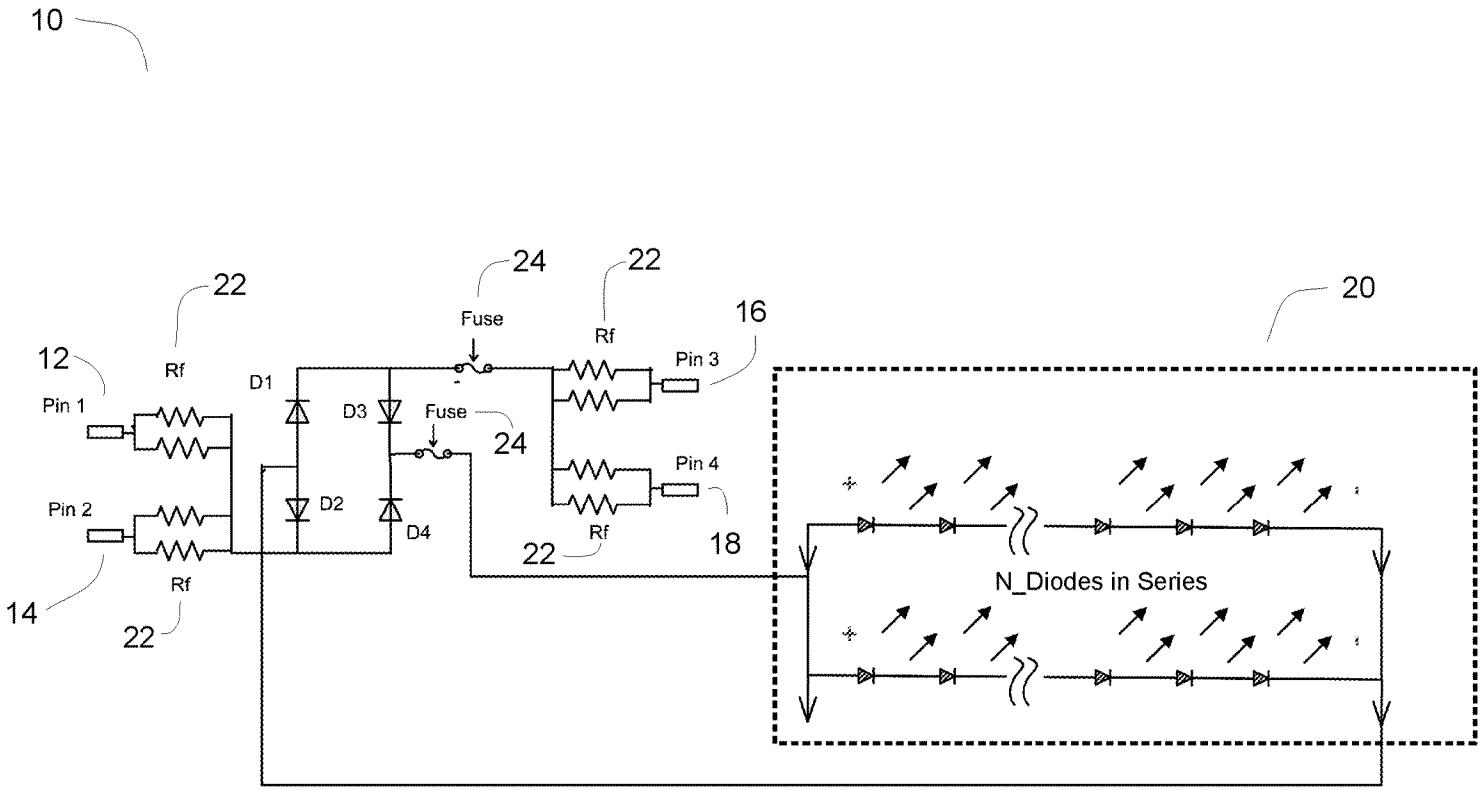
FIG. 2 is an electrical schematic of a typical LED replacement lamp.

FIG. 2 illustrates a schematic view of an embodiment of the solid-state lighting arrangement 10, including input Pin_1, 12 Pin_2, 14 Pin_3, 16 and Pin_4 18. The arrangement includes resistors 22 to emulate filament resistance and fuses 24 for safety. Lighting is produced by solid-state light source 20 comprising a series of Light Emitting Diodes (LEDs) configured between the two sets of input pins 12, 14, 16, 18 when current flows between Pin_1/Pin_2 12/14 and Pin_3/Pin_4 16/18.

Figure 3:
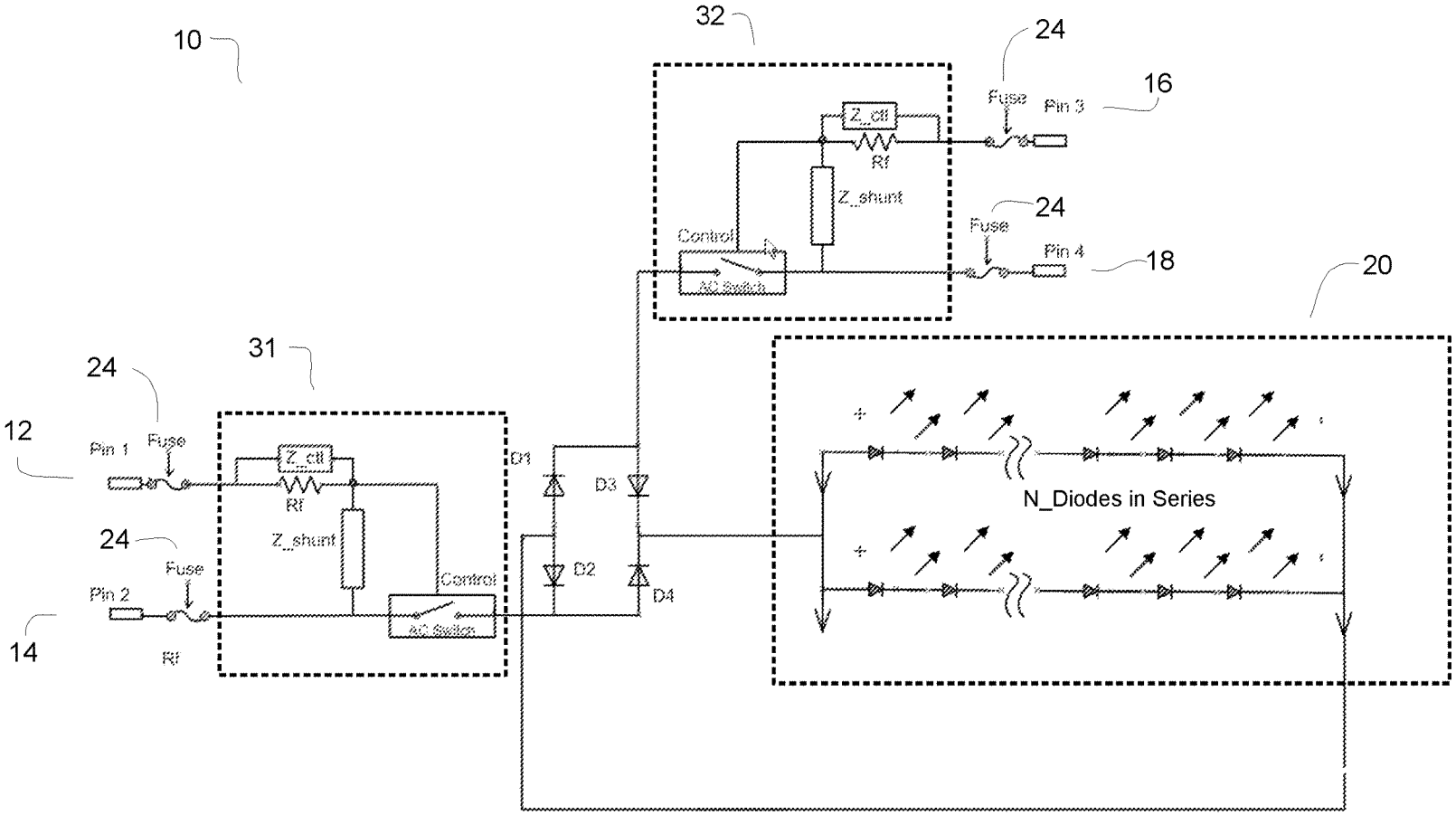
FIG. 3 is an electrical schematic of an LED replacement lamp with an AC switch controlled by filament voltage across the bipins.

A variation of the solid-state lighting arrangement 10 from FIG. 2, is shown in FIG. 3. In this variation, safety requirements, may be met by the inclusion of a circuitry 31, 32 to perform filament sensing and switching out Pin_1 12 and Pin_2 14 and/or Pin_3 16 and Pin_4 18, until safe and sufficient filament voltage is sensed and the switches 33, 34 which separate the two sets of bipins, Pin_1 12 and Pin_2 14; and Pin_3 16 and Pin_4 18 are closed, allowing current to flow through the solid-state light source 20.

Figure 4:
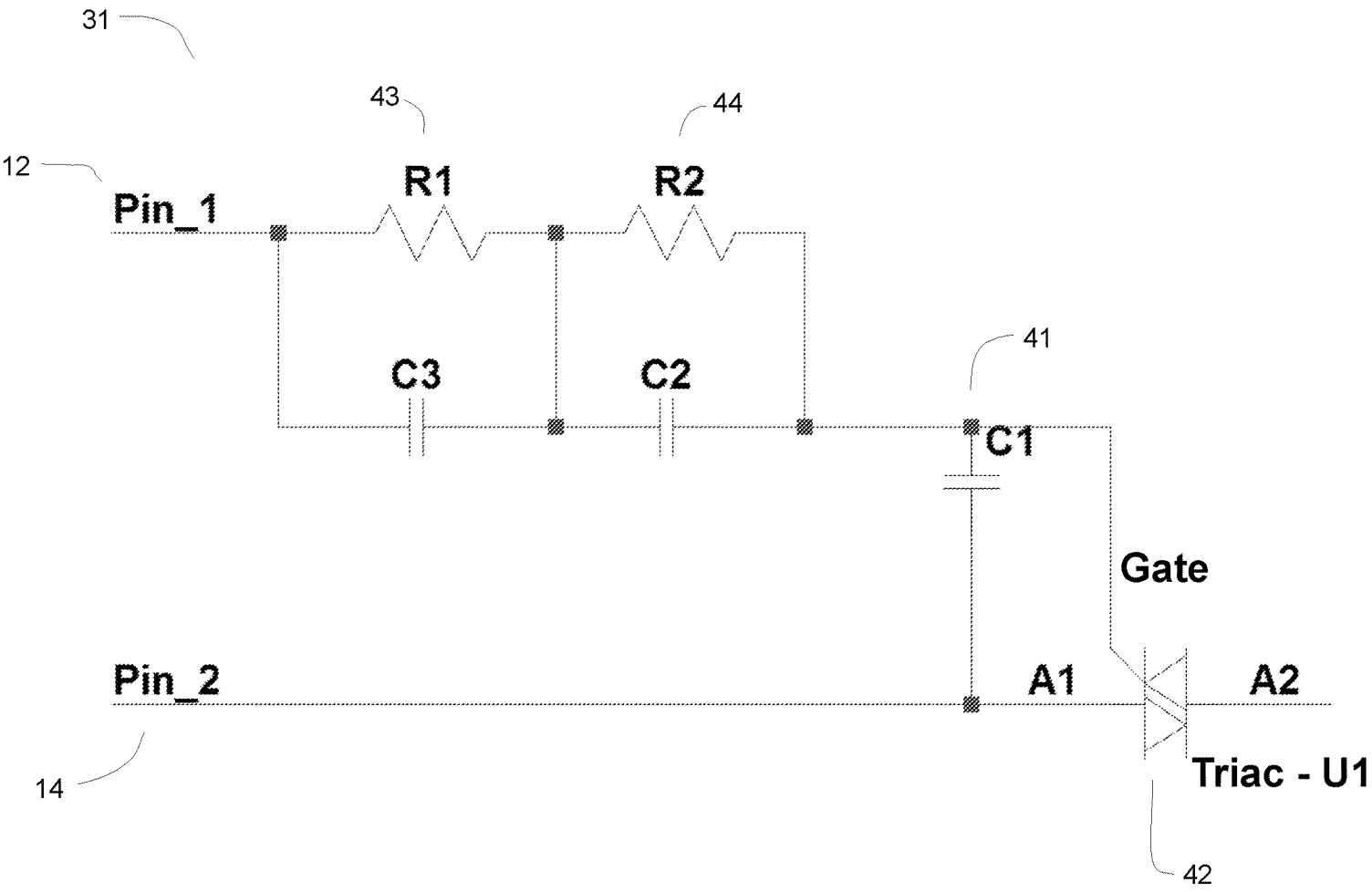
FIG. 4 is an electrical schematic illustrating implementing AC switching according to the present invention through use of a triac.

A practical embodiment of such a circuit 31 is shown, schematically, in FIG. 4. Although in FIGS. 4 through 6, only the circuitry associated with Pin_1 12 and Pin_2 14 is shown, it is understood that the corresponding circuitry is also found associated with Pin_3 16 and Pin_4 18. When the filament voltage is applied between Pin_1 12 and Pin_2 14 voltage will appear across capacitor C1 41 that will trigger triac 42, if above threshold. Before the triac 42 is triggered, the resistance between anodes, A1 and A2, is high limiting any current flow. After the gate is triggered the impedance between anodes A1 and A2 of triac 42 drops, conducting current from Pin_2 14 through the triac 42 to light the solid-state light source (not shown). If either Pin_1 12 or Pin_2 14 are open, there is no path for the gate current to turn on the triac 42.

Figure 5:
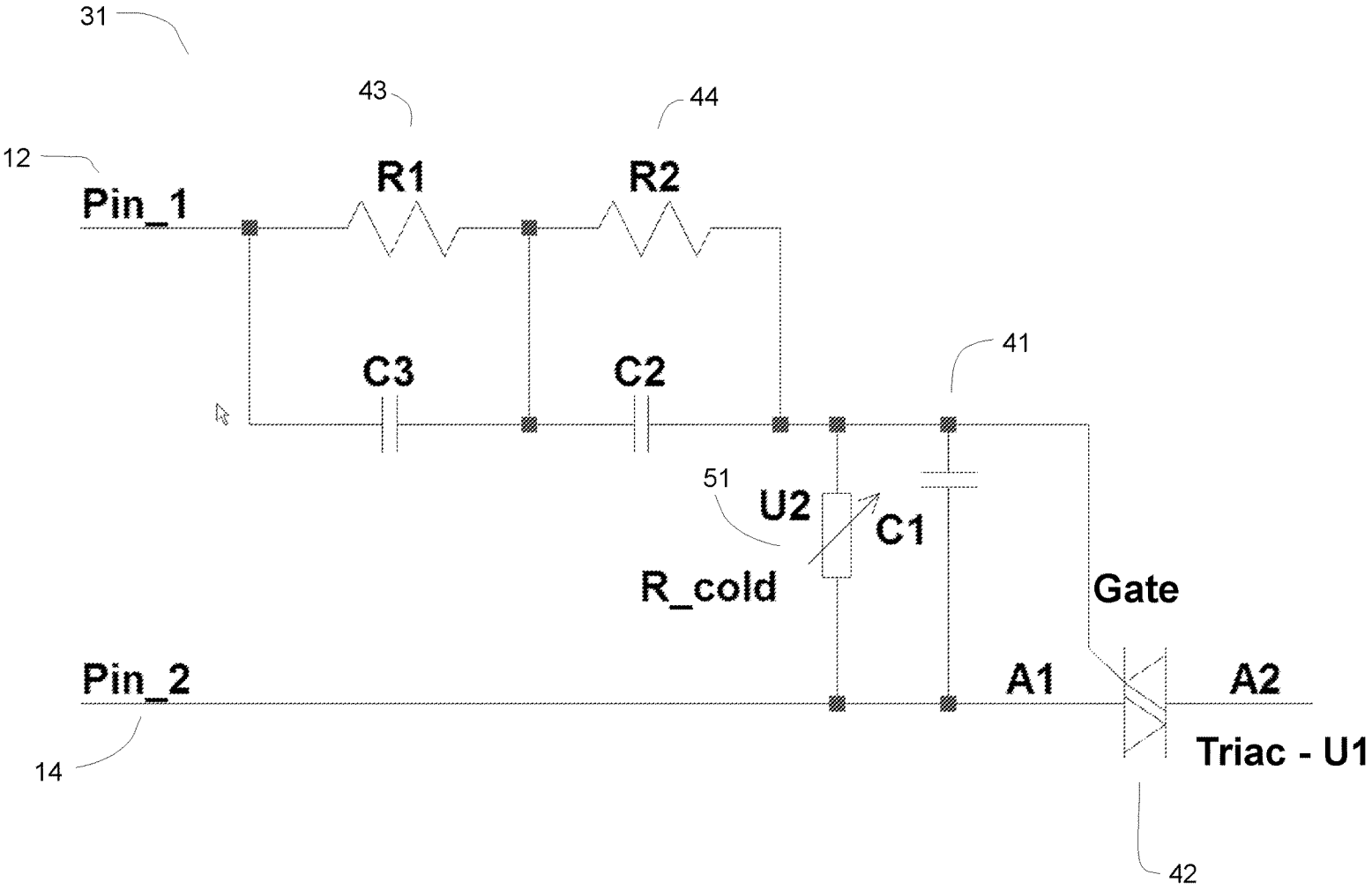
FIG. 5 is an electrical schematic illustrating implementing AC switching according to the present invention through use of a thermistor to emulate the change in resistance due to self-heating and providing additional delay in conductance through the lamp.

During tests, such as the UL935 thru lamp leakage test, one of the pins on the lamp is opened and no current will flow thru the lamp. Such a test simulates installation of a lamp when the ballast is energized so this provides protection for the installer. Resistors, R1 43 and R2 44 simulate the filament current circuit thru the gate and capacitor, C1 41 in parallel. An additional resistor may be added in series with the gate of the triac 42 if the gate can't sustain full filament current. In addition, an additional passive component across capacitor, C1, 41, can shunt excessive current. The value of capacitance for capacitor C1, 41, can determine a small delay before the solid-state light source 20 (not shown in FIGS. 4 and 5) illuminates. FIG. 5 illustrates a circuit in which additional delay is achieved by emulating the change in resistance due to self-heating, by use of a thermistor 51.

The AC switch circuits described above and illustrated in FIGS. 4 and 5, will operate to provide solid-state illumination for magnetic rapid start ballasts as well as high-frequency electronic program start ballasts. In addition, the AC switch circuitry will beneficially prevent current flow thru the solid-state light source if any pin in the lamp is open, providing protection from electrical shock.

Figure 6:
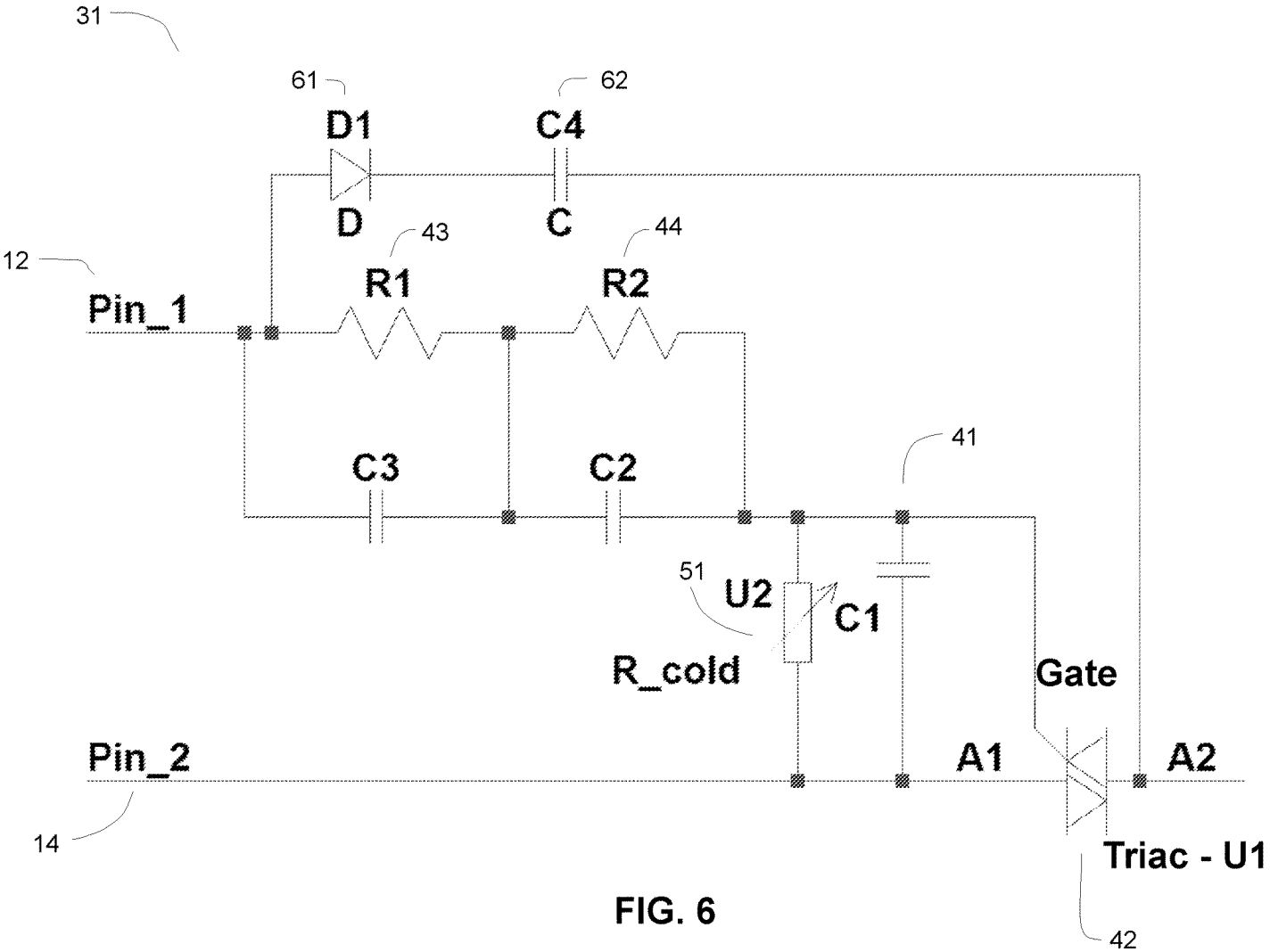
FIG. 6 is an electrical schematic illustrating implementing AC switching according to the present invention that will still provide full emulation of a fluorescent lamp when operating with an instant start ballast.

FIG. 6 illustrates switch circuitry which will operate with another type of high-frequency electronic ballast for fluorescent lamps, known as an instant start ballast. Instant-start ballasts allow for illumination of traditional fluorescent lights without the delay for filament heating, by applying voltage across the lamp at above the ionization voltage without waiting for filament heating. The gas ionizes immediately to a plasma and creates light in the fluorescent lamp without delay.

When using LED lamp on instant start ballast, the lamp will light as soon as the applied ballast voltage is above the voltage of the series diodes. The ballast limits the current in to the LED that are turned on. The instant start ballast is isolated from the main voltage and ground so little current will flow thru the LED lamp when one end of the lamp is lifted out of the connector. The only coupling to ground is thru the capacitance of the isolation transformer inside the ballast. The current to ground is limited. Since the frequency and voltage across the lamp are high, current may flow when an open end of the lamp is connected the circuit during the UL935test. Depending on conditions, this current could exceed 5 ma rms, and fail the test. In normal operation on the instant start ballast, the LED AC switch would prevent the lamp from lighting because of lack of filament voltage.

FIG. 6 schematically illustrates an AC switching circuit 31 in which the triac 42 may be triggered multiple ways. The emulation of filament heating provides gate voltage and current between anode A1 and the gate of the triac 42. If anode A1 of triac 42 is connected to the gate thru a resistor, the triac 42 will turn on if there is positive voltage on anode A2 of the triac 42. Adding a diode D1 61 and capacitor C4 62 as illustrated in FIG. 6, provide the positive voltage needed to trigger the connection between anode A2 and the gate of triac 42. The value of capacitor C4 62 may be adjusted so the voltage of an instant ballast will turn on the triac 42 when normally connected but prevent the turn on with the lower lamp voltage applied in the magnetic and high frequency ballast with filament heating. The lamp can be used universally on all ballast types and pass the requirement of UL935 if the ballast also passes on fluorescent lamps.

Any element in a claim that does not explicitly state "means" for performing a specified function or "step" for performing a specified function, should not be interpreted as a "means" or "step" clause as specified in 35 U.S.C. § 112.

What is claimed is:

1. A solid-state lighting arrangement for use in assuring safe operation of a lighting fixture having ballast circuitry capable of powering at least one gas discharge lamp when used with a solid-state light source, the arrangement comprising:

a first input adapted for coupling to a first lamp connection within the lighting fixture;

a second input adapted for coupling to a second lamp connection within the lighting fixture;

a third input adapted for coupling to a third lamp connection within the lighting fixture;

a fourth input adapted for coupling to a fourth lamp connection within the lighting fixture;

a solid-state light source operably coupled to the first, second, third and fourth lamp connections;

wherein the first and second inputs directly couple to a first end of the solid-state light source and the third and fourth inputs directly couple to a second end of the solid-state light source;

AC switching circuitry, operably coupled to the inputs;

said AC switching circuitry comprising a first thyrister operably coupled via a first control circuit to the first or second inputs and a second thyrister operably coupled via a second control circuit to the third or fourth inputs; and wherein the first thyrister is directly electrically connected, without intervening components, to the second thyrister.

2. A solid-state lighting arrangement for use in assuring safe operation of a lighting fixture having ballast circuitry capable of powering at least one gas discharge lamp when used with a solid-state light source, the arrangement comprising:

a first input adapted for coupling to a first lamp connection within the lighting fixture;

a second input adapted for coupling to a second lamp connection within the lighting fixture;

a solid-state light source operably coupled to the first and second lamp connections;

wherein the first and second inputs directly couple to a first end of the solid-state light source;

a thermister electrically coupled between the first and second inputs; and a first thyrister and a second thyrister, wherein the anode of the first thyrister is directly connnected to the cathode of the second thyrister and the cathode of the first thyrister is directly connected to the anode of the second thyrister and the first and second thyristers share a common gate input, said gate input operably connected to the first lamp.

3. A solid-state lighting arrangement for use in assuring safe operation of a lighting fixture having ballast circuitry capable of powering at least one gas discharge lamp when used with a solid-state light source, the arrangement comprising:

a first input adapted for coupling to a first lamp connection within the lighting fixture;

a second input adapted for coupling to a second lamp connection within the lighting fixture;

a solid-state light source operably coupled to the first and second lamp connections;

wherein the first and second inputs directly couple to a first end of the solid-state light source;

a thermister electrically coupled between the first and second inputs; and a first capacitor connected in parallel with the thermister between the first and second inputs;

a triac, wherein a first anode of the triac is connected to one end of the parallel connection of the thermister and the first capacitor and to the second input, and a second anode of the triac is electrically connected to the first input via a serially connected diode and a second capacitor.

* * * * *